US005601223A

United States Patent [19]

Koch et al.

[11] Patent Number: 5,601,223

[45] Date of Patent: Feb. 11, 1997

[54] CABLE TRANSPORTING AND TURNING DEVICE

[75] Inventors: Max Koch, Meggen; Alois Lustenberger, Littau; Urs Dober, Immensee, all of Switzerland

[73] Assignee: Komax Holding AG, Meggen, Switzerland

[21] Appl. No.: 546,596

[22] Filed: Oct. 23, 1995

[30] Foreign Application Priority Data

Oct. 21, 1994 [CH] Switzerland ..... 03171/94

[51] Int. Cl.[6] ..... B65H 20/04; B65H 20/40

[52] U.S. Cl. ..... 226/172; 226/177; 226/187; 226/188; 474/88; 474/134

[58] Field of Search ..... 226/172, 176, 226/177, 186, 187, 188; 474/84, 85, 88, 133, 134, 135

[56] References Cited

U.S. PATENT DOCUMENTS

| | | | |
|---|---|---|---|
| 3,014,628 | 12/1961 | Littlehale | 226/172 |
| 3,318,221 | 5/1967 | Erikson | 226/187 |
| 4,846,388 | 7/1989 | Benbow | 226/187 |
| 5,000,439 | 3/1991 | Yoshizawa | 226/187 |

FOREIGN PATENT DOCUMENTS

| | | | |
|---|---|---|---|
| 0527616 | 7/1956 | Canada | 226/186 |
| 0630945 | 11/1961 | Canada | 226/172 |
| 1035607 | 8/1958 | Germany | 226/187 |
| 0177646 | 8/1991 | Japan | 474/84 |
| 0458877 | 3/1975 | U.S.S.R. | 226/187 |

*Primary Examiner*—Daniel P. Stodola
*Assistant Examiner*—Matthew A. Kaness
*Attorney, Agent, or Firm*—Hazel & Thomas

[57] ABSTRACT

At least two transporting and take-off rollers (2, 2') interact for the gripping of a cable (1) to be transported. The axes of rotation (3, 3') of the transporting and take-off rollers are each rotatably arranged on a cantilever arm (7, 7') capable of swivelling together about a second turning axis (6) arranged on a turning platform (10) and running perpendicular to the former axis and parallel to a common straight line (5) connecting the said two rollers (2, 2'). At least one of the two transporting and take-off rollers (2, 2') is arranged laterally adjustable in relation to its distance (a) from the second transporting and take-off roller (7). Further, first drive devices (25) connected so that they can swivel together with the turning platform (10), are provided for driving the two transporting and take-off rollers (2, 2'). Second drive devices (16) drive-connected to the turning platform (10) are provided for obtaining a precisely defined rotational movement of the turning platform (10) about the first turning axis (4).

18 Claims, 3 Drawing Sheets

CABLE TRANSPORTING AND TURNING DEVICE

BACKGROUND AND SUMMARY OF THE INVENTION

The invention relates to a cable transporting and turning device.

The object of the present invention is to create a cable transport and turning device which is capable of feeding extremely precise lengths of cable to various cable processing stations arranged in a turning area, such as, for example, cable insulation stripping stations, crimping presses, tinning and sleeve-processing equipment etc., over as short a distance as possible from the cable gripping area of the transport rollers to the cable gripping area of the associated cable processing stations, and drawing them back for insulation stripping. This is done because large distances, especially in the case of thin, elastic conductors, have an extremely negative influence on the harding of cables, for example, on the consistency of the stripping length.

According to the invention this object is achieved by means of a cable transporting and turning device that is characterized by at least two transporting and take-off rollers that interact for the gripping of a cable to be transported. First and second axes of rotation of the two transporting and take-off rollers run parallel to one another and parallel to a common first turning axis. The two transporting and take-off rollers are rotatably arranged on first and second cantilever arms, respectively, that are capable of swivelling together about a second turning axis and of running perpendicular to the common first turning axis and parallel to a common straight line connecting said transporting and take-off rollers. The second turning axis is operatively mounted on a turning platform. At least the first cantilever arm is operatively mounted to allow a corresponding one of the two transporting and take-off rollers to be laterally adjustable in relation to a distance (a) from the second transporting and take-off roller. A first drive means, connected to the two transporting and take-off rollers together with the turning platform, is provided for the mutually synchronous, precisely defined drive of the two transporting and take-off rollers. A second drive means, drive-connected to the turning platform, is provided for obtaining a precisely defined rotational movement of the turning platform about the first turning axis. Lastly, an inlet cable guide is provided on a cable feed side of the transporting and take-off rollers that opens in a cable gripping area, and an outlet cable guide on a cable delivery side of the transporting and take-off rollers that opens in a cable outlet area device according to claim 1.

BRIEF DESCRIPTION OF THE DRAWING

The invention will now be described by way of example with reference to the drawing, in which.

DETAILED DESCRIPTION OF THE PREFERRED EMBODIMENT

Figure 1:
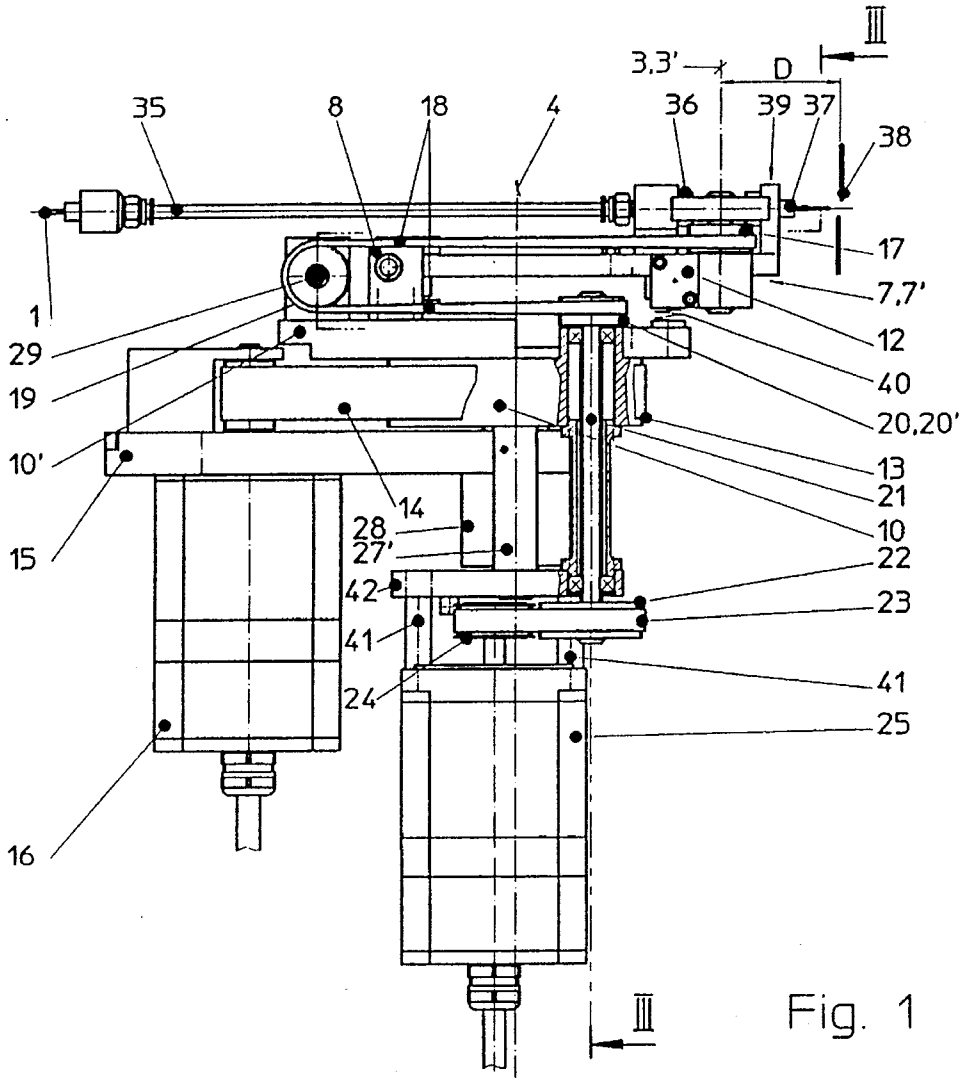
FIG. 1 shows a side view of such a device partially represented in cross-section.
Figure 2:
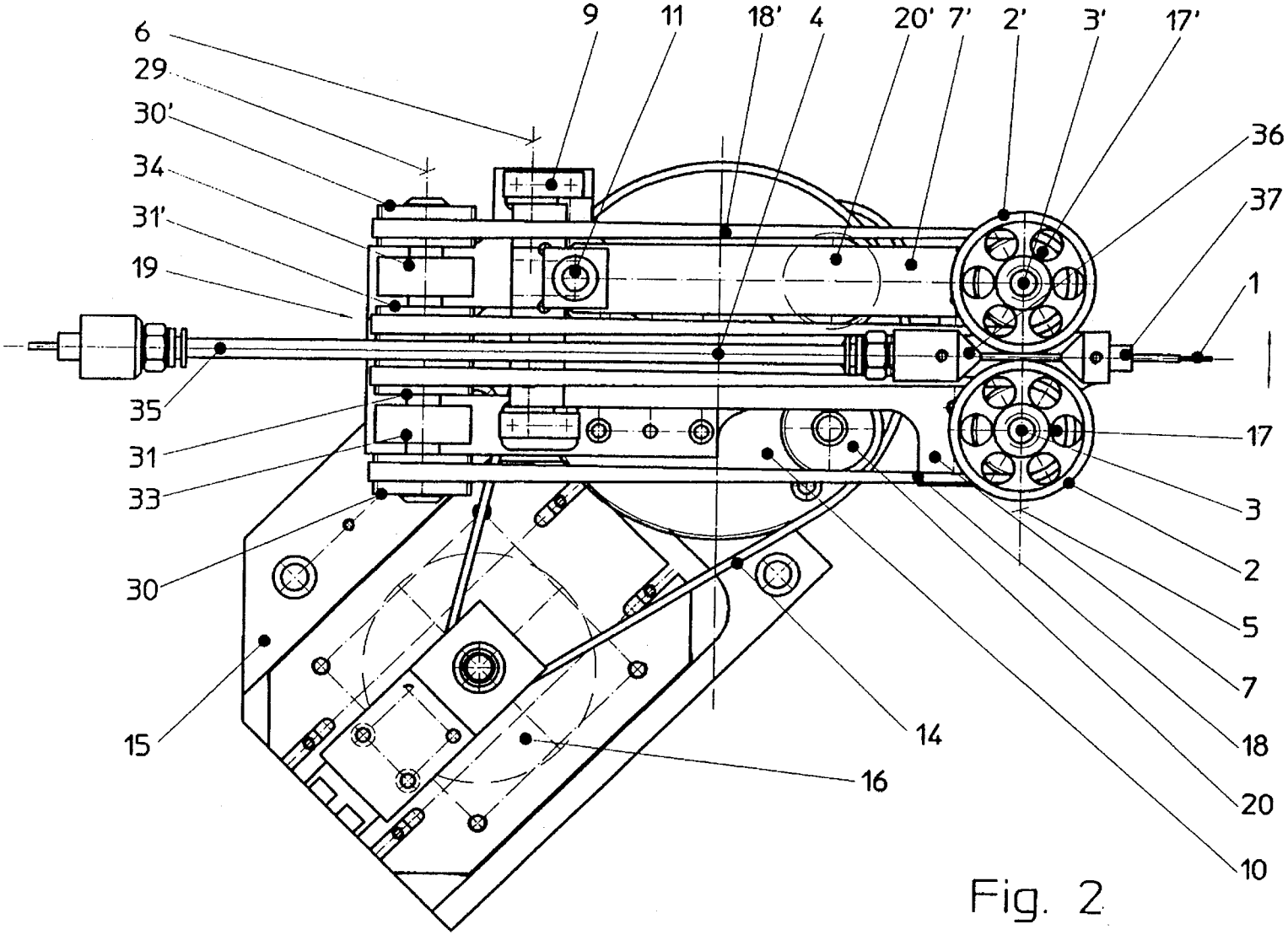
FIG. 2 shows a plan view of the device represented in FIG. 1.

As can be seen from the drawing, the cable transporting and turning device shown has two transporting and take-off rollers 2, 2' interacting for the gripping of a cable 1 to be transported, the axes of rotation 3, 3' of which transporting and take-off rollers run parallel to one another and parallel to a common first turning axis 4, and are each rotatably arranged on a cantilever arm 7, 7', together lowerable about a second turning axis 6 running perpendicular to the first turning axis 4 and parallel to a common straight line 5 connecting said two rollers 2, 2'. The turning axis 6 is itself supported by way of bearing blocks 8 and 9 on an intermediate plate 10' and the latter in turn fixed on a turning platform 10.

For adjustment of the roller contact pressure, the one turning arm 7' is mounted in a plane running perpendicular to the axis of rotation 3, 3' of said rollers 2, 2' so that it can swivel about a turning axis 11. A pneumatic cylinder 12 serves for the lateral swivelling of the swivel-mounted turning arm 7'. In this, the contact pressure is adjusted by way of a pneumatic pressure regulator (not shown) connected to the pneumatic cylinder 12 on the inlet side. The turning platform 10 is formed with gear toothing along its outer circumference 13 and drive-connected by way of a toothed belt 14 to a stepping motor 16 fixed in a stationary base plate 15, which stepping motor enables a very precisely defined turning movement to be performed about a certain turning angle.

The second turning arm 7 is capable of swivelling downwards only together with the first turning arm 7' about the turning axis 6 against the spring action of a pressure spring 40, but is not capable of swivelling laterally.

The two transporting and take-off rollers 2, 2', for their synchronous drive in opposite directions, are each connected to a gear-toothed drive wheel 17 and 17' respectively, for the driving of which a respective endless toothed belt 18 and 18' runs around said wheels, above the cantilever arms 7 and 7', out at the rear by way of the second turning axis 6 of the latter, and thence by means of a deflection and tensioning arrangement 19 downwards and beneath the cantilever arms 7 and 7' each with a gear-toothed end roller 20 and 20', supported on the turning platform 10 by way of the intermediate plate 10'. Here, the axes of rotation of both the said end rollers run parallel to the first turning axis 4.

For its drive, the end roller 20' is fixed by way of a drive shaft 21 to a drive wheel 22 which is formed with gear toothing on its outer circumference and is drive-connected by way of a toothed belt 23 to a gear-toothed driven wheel 24 of a stepping motor 25.

The stepping motor 25, in order to obtain the lowest possible moment of inertia when swivelling the cable transporting and turning unit connected to it, is arranged as close as possible in the longitudinal direction of the first turning axis 4, and is connected by way of four spacer pins 41 to an engine support flange 42, which is in turn connected by way of the connecting pins 26, 27 and 27' and a connecting shaft 28' to the turning platform 10 to form a common unit capable of swivelling about the first turning axis 4, said unit being swivel-mounted in the bearing block 28, connected to the stationary base plate 15, by way of the connecting shaft 28'.

Figure 3:
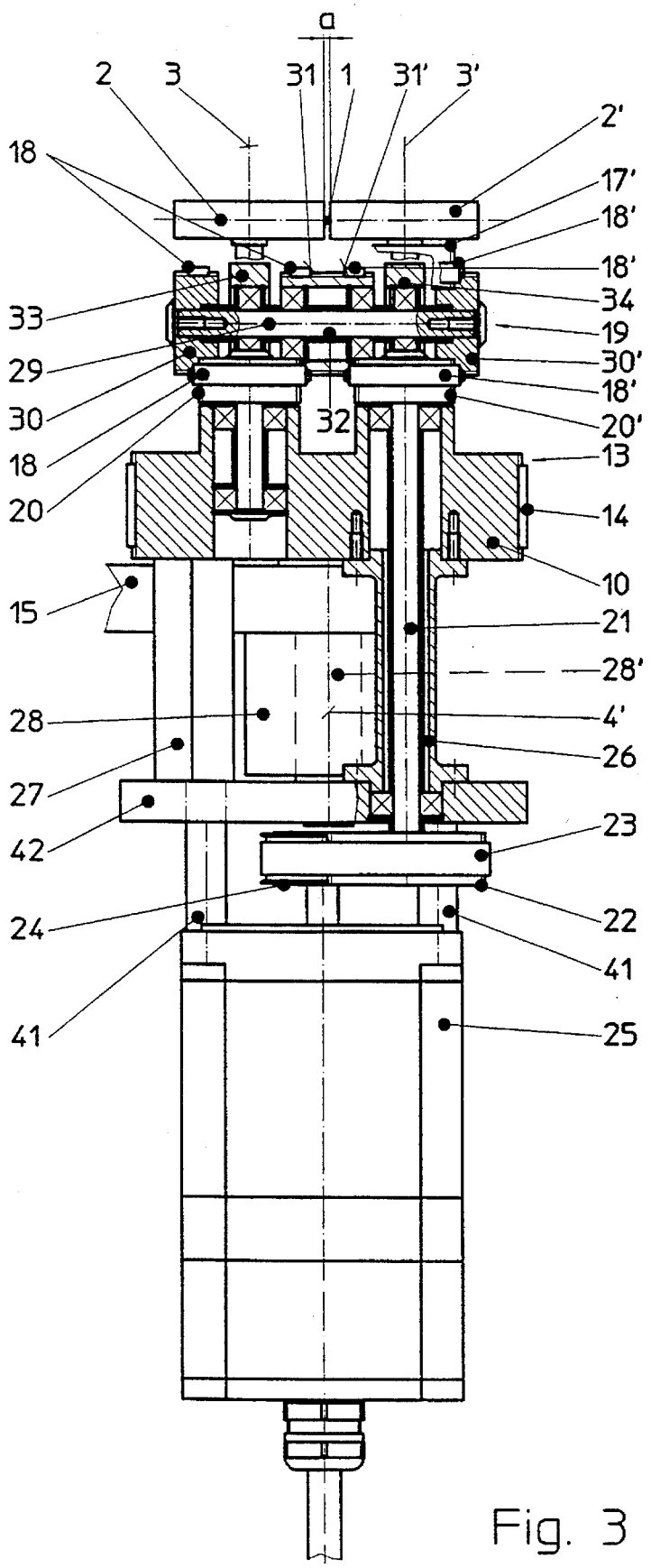
FIG. 3 shows, on a larger scale, a section along the line III—III in FIG. 1.

As can be seen in particular from FIG. 3, the toothed belt deflection arrangement 19 is formed by four gear-toothed deflection rollers 30, 30' and 31, 31', rotatably arranged along an axis of rotation 29. The axis of rotation 29 runs parallel to the second turning axis 6. The rollers 30, 30' and 31, 31' mesh with the toothed side of the toothed belts 18, 18', respectively. One strand of the toothed belt 18 is fixed non-rotatably to the deflection roller 30' or 31', respectively associated with a corresponding strand of the other toothed belt 18', so that a synchronous drive of the two transporting and take-off rollers 2 and 2' in opposite directions of rotation inevitably results.

In the embodiment shown, the deflection roller 30 is fixed non-rotatably by way of a connecting shaft 32 to the deflection roller 30', and the connecting shaft 32 is supported by way of the bearing blocks 33 and 34 and the intermediate plate 10' on the turning platform 10.

In this embodiment the two deflection rollers 31 and 31' are connected to one another to form a single roller and, independently of the connecting shaft 32, are rotatably supported thereon by way of two ball bearings.

On the cable feed side of the transporting and take-off rollers 2, 2' an inlet cable guide 36 is provided, opening in their cable gripping area and connected to a flexible guide hose 35, and on the cable delivery side of the transporting and take-off rollers 2, 2' an outlet cable guide 37 is provided, opening in their cable outlet area.

As can be seen from the transporting and turning device shown, the separating and stripping unit 38 (see FIG. 1) can be arranged extremely close with respect to the cable delivery point of the rollers 2, 2', that is, for example, at a distance D of approximately 40 to 50 mm for a roller diameter of 45 mm.

If the device shown is used in combination with a crimping unit, the latter is then used with a stop which is linked to the movement of the pressing ram and which, when the pressing process in cutting/clamping-type contacts of an IDC casing is performed, presses on the stop 39 of the cable outlet guide 37, thereby swivelling the latter downwards to the same extent that the pressing ram or the pressed end of the cable 1 is moved downwards in the process.

The position of the second turning axis 6 is selected in such a way that, when the transporting and take-off rollers 2, 2' are lowered, the toothed belts 18, 18', tensioned around the drive rollers 17, 17' connected thereto, are not overstrained but are not too loosely tensioned in the upper starting position.

We claim:

1. A cable transporting and turning device for feeding precise lengths of cable to at least one cable processing station located peripherally with said device, characterised in that at least two transporting and take-off rollers that interact for the gripping of a cable to be transported, first and second axes of rotation of the two transporting and take-off rollers running parallel to one another and parallel to a common first turning axis, are rotatably arranged on first and second cantilever arms, respectively, that are capable of swivelling together about a second turning axis, the second turning axis being operatively mounted on a turning platform and of running perpendicular to the common first turning axis and parallel to a common straight line connecting said transporting and take-off rollers, wherein at least the first cantilever arm is operatively mounted to allow a corresponding one of the two transporting and take-off rollers to be laterally adjustable in relation to a distance (a) from the second transporting and take-off roller, a first drive means, connected to the two transporting and take-off rollers together with the turning platform is provided for the mutually synchronous, precisely defined drive of the two transporting and take-off rollers, a second drive means, drive-connected to the turning platform, is provided for obtaining a precisely defined rotational movement of the turning platform about the first turning axis, an inlet cable guide is provided on a cable feed side of the transporting and take-off rollers that opens in a cable gripping area, and an outlet cable guide is provided on a cable delivery side of the transporting and take-off rollers that opens in a cable outlet area.

2. A device according to claim 1, characterised in that the first and second drive means are each provided with stepping motors.

3. A device according to claim 1, characterised in that the first cantilever arm for adjustment of the distance (a) of the two transporting and take-off rollers, is mounted to swivel in a plane running perpendicular to the axes of rotation of the said rollers and is connected to a means for adjusting at least one of the distance (a) and a contact pressure of said two transporting and take-off rollers on the cable to be transported.

4. A device according to claim 1, characterised in that the turning platform is provided on its circumference with a gear-toothed profile operatively connected via a toothed belt to the second drive means.

5. A device according to claim 1, characterised in that the two transporting and take-off rollers are each connected to a gear-toothed drive wheel that is driven via a respective first or second endless toothed belt extending around said wheel, above the cantilever arms toward a rear end of the first and second cantilever arms by way of the second turning axis, and via a toothed belt deflection arrangement downwards beneath the cantilever arms, each respective first or second endless toothed belt meshing with a corresponding one of first and second gear-toothed end rollers supported on the turning platform, an axis of rotation of each said first an second end rollers running parallel to the first turning axis, one of the first and second end rollers being connected to the first drive means, wherein the toothed belt deflection arrangement is formed by first, second, third and fourth gear-toothed deflection rollers, rotatably arranged along an axis of rotation which runs parallel to the second turning axis, the gear-toothed deflection rollers meshing with the toothed side of a corresponding one of the first and second toothed belts, the first and third deflection rollers being engaged with a first strand of the first toothed belt, the first deflection roller being fixed non-rotatably to the second deflection roller, the second and fourth deflection rollers being engaged with a corresponding strand of the second toothed belt, so as to synchronously drive the transporting and take-off rollers in opposite directions.

6. A device according to claim 5, characterised in that a longitudinal axis of a drive motor of the first drive means runs parallel to and at least approximately coincident with the first turning axis.

7. A device according to claim 5, wherein the first and second drive means are each provided with stepping motors, and the first cantilever arm for adjustment of the distance (a) of the two transporting and take-off rollers is mounted to swivel in a plane running perpendicular to the axis of rotation of the said rollers and is connected to a means for adjusting at least one of the distance (a) and a contact pressure of said two transporting and take-off rollers on the cable to be transported.

8. A device according to claim 1, characterised in that the inlet cable guide is connected to a flexible guide hose, and the outlet cable guide is no more than 10 to 30 mm long.

9. A device according to claim 8, characterised in that a cable gripping point of a cable processing station in a cable delivery turning area is arranged with the outlet cable guide directed towards the cable gripping point, an outlet opening of the said outlet cable guide being no more than 5 to 30 mm from the said cable gripping point.

10. A device according to claim 9, wherein at least one of a separating and insulation-stripping cutter unit and a crimping unit are arranged in the cable delivery turning area.

11. A cable transporting and turning device for feeding predetermined lengths of cable to at least one cable processing station located peripherally relative to said device, comprising:

a turning platform having a first turning axis defined therethrough;

first and second cantilever arms operatively mounted on said turning platform and extending perpendicular to said first turning axis, each of said cantilever arms being further mounted toward a base end thereof so as to swivel about a second turning axis defined perpendicular to said first turning axis;

first and second transporting rollers operatively engaged with each other for gripping a cable to be transported therebetween, each of said first and second transporting rollers being rotatably mounted on a distal end of a corresponding one of said first and second cantilever arms, each of said first and second transporting rollers being further rotatably mounted along first and second axes of rotation, respectively, defined parallel to one another and parallel to said first turning axis;

a first drive means operatively connected to said first and second transporting rollers, for synchronously driving said first and second transporting rollers;

a second drive means for rotatively driving said turning platform about the first turning axis, said first drive means being mounted on said turning platform so as to drive said transporting rollers while said turning platform is rotatively driven, wherein at least said first cantilever arm includes means for laterally adjusting said first transporting roller thereon relative to said second transporting roller;

an inlet cable guide on a cable feed side of said transporting rollers that opens in a cable gripping area; and an outlet cable guide on a cable delivery side of said transporting rollers that opens in a cable outlet area.

12. A device according to claim 11, wherein each of said first and second drive means includes a stepping motor.

13. A device according to claim 11, wherein said first cantilever arm is further mounted to swivel in a plane defined perpendicular to said axes of rotation of said rollers, and includes means for adjusting at least one of a lateral distance from said first transporting roller to said second transporting roller and a contact pressure of said transporting rollers on said cable to be transported.

14. A device according to claim 11, wherein said turning platform includes gear teeth along an outer circumference thereof and a toothed belt operatively engaging said turning platform with said second drive means.

15. A device according to claim 11, further comprising:

first and second endless belts, wherein each of said first and second transporting rollers includes a gear-toothed drive wheel, said first and second endless belts each being engaged with a corresponding one of said gear-toothed drive wheels of said first and second transporting rollers and extending toward a base end of said first and second cantilever via a toothed belt deflection device to engage with a corresponding one of first and second gear-toothed end rollers mounted on said turning platform, an axis of rotation of each said first an second end rollers being defined parallel to said first turning axis, and at least one of said first and second end rollers being connected to said first drive means, wherein said toothed belt deflection device includes first, second, third and fourth gear-toothed deflection rollers, rotatably arranged along a deflection axis of rotation defined parallel to said second turning axis, said first and third deflection rollers being engaged with said first endless belt, said second and fourth deflection rollers being engaged with said second endless belt, and said first and third deflection rollers being operatively connected to said second and fourth deflection rollers, respectively, so as to synchronously drive said transporting and take-off rollers in opposite directions.

16. A device according to claim 15, wherein a longitudinal axis of a drive motor of said first drive means is defined parallel to said first turning axis.

17. A device according to claim 15, wherein each of said first and second drive means includes a stepping motor, and said first cantilever arm is further mounted to swivel in a plane defined perpendicular to said axes of rotation of said rollers, and includes means for adjusting at least one of a lateral distance from said first transporting roller to said second transporting roller and a contact pressure of said transporting rollers on said cable to be transported.

18. A device according to claim 11, wherein said inlet cable guide includes a flexible guide hose, and said outlet cable guide is 10 to 30 mm long.

* * * * *